US007934538B2

(12) United States Patent
Obayashi et al.

(10) Patent No.: US 7,934,538 B2
(45) Date of Patent: May 3, 2011

(54) HEAT EXCHANGER AND WATER HEATER

(75) Inventors: Toshihiko Obayashi, Hyogo (JP); Satoshi Kawaguchi, Hyogo (JP); Hidefumi Koda, Hyogo (JP); Kohei Yamada, Hyogo (JP)

(73) Assignee: Noritz Corporation, Hyogo (JP)

( * ) Notice: Subject to any disclaimer, the term of this patent is extended or adjusted under 35 U.S.C. 154(b) by 939 days.

(21) Appl. No.: 11/882,794

(22) Filed: Aug. 6, 2007

(65) Prior Publication Data

US 2008/0035077 A1 Feb. 14, 2008

(30) Foreign Application Priority Data

Aug. 8, 2006 (JP) ..... 2006-215803

(51) Int. Cl.
*F28F 9/12* (2006.01)

(52) U.S. Cl. ..... 165/76; 165/81; 165/178; 285/133.21

(58) Field of Classification Search ..... 165/76, 165/78, 81, 82, 178; 285/281, 368, 412
See application file for complete search history.

(56) References Cited

U.S. PATENT DOCUMENTS

| | | | | |
|---|---|---|---|---|
| 1,555,646 | A * | 9/1925 | Emmet | 122/260 |
| 2,628,851 | A * | 2/1953 | Jessup | 285/408 |
| 3,380,516 | A * | 4/1968 | Kaye | 165/81 |
| 3,534,712 | A * | 10/1970 | Reynolds | 122/225 R |
| 3,805,745 | A * | 4/1974 | Block et al. | 122/367.3 |
| 4,164,255 | A * | 8/1979 | Binet et al. | 165/82 |
| 4,511,106 | A * | 4/1985 | Graves | 248/65 |
| 4,921,680 | A * | 5/1990 | Bonk et al. | 422/197 |
| 2005/0051319 | A1 * | 3/2005 | Crook | 165/178 |
| 2006/0108795 | A1 * | 5/2006 | Manzon | 285/197 |

FOREIGN PATENT DOCUMENTS

| | | |
|---|---|---|
| JP | 57-200853 U | 6/1981 |
| JP | 64-012151 U | 1/1989 |
| JP | 04-022216 U | 2/1992 |

* cited by examiner

*Primary Examiner* — Allen J Flanigan
(74) *Attorney, Agent, or Firm* — Rader, Fishman & Grauer PLLC

(57) ABSTRACT

A plurality of first joint tubes 40 connected to a plurality of heat transfer tubes 3 and a plurality of second joint tubes 50 provided at a header 5B are connected to each other at joints J. The joints J include at least one slide joint Ja at which respective ends of the first and the second joint tubes 40 and 50 are fitted to each other slidably in a predetermined direction. The joints J further include at least one butt joint Jb at which an end of either one of the first and the second joint tubes butts against a sealing surface provided at the other one of the first and the second joint tubes. The butt position of the sealing surface and the end is variable in a direction crossing the predetermined direction. With this arrangement, the influence of an error in the arrangement of the first and the second joint tubes 40 and 50 is reduced, so that the header 5B is properly connected to the heat transfer tubes 3 detachably, and the maintenance of the heat exchanger HE is facilitated.

8 Claims, 7 Drawing Sheets

HEAT EXCHANGER AND WATER HEATER

BACKGROUND OF THE INVENTION

1. Field of the Invention

The present invention relates to a heat exchanger for generating hot water by heat recovery from combustion gas generated by a burner, for example. The invention also relates to a water heater provided with such a heat exchanger.

2. Description of the Related Art

For example, a conventional heat exchanger includes a casing into which combustion gas is to be introduced and a plurality of heat transfer tubes arranged in the casing. A water inflow header and a hot-water outflow header are connected to the heat transfer tubes. (See Japanese laid-open utility model publication No. 57-200853, Japanese laid-open utility model publication No. 64-12151 and Japanese examined utility model publication No. 4-22216, for example.)

With this structure, when water is supplied to the water inflow header, the water flows into the plurality of heat transfer tubes and is heated while flowing through the tubes. The hot water produced in this way merges at the hot-water outflow header and is supplied from the header to the intended faucet or place. The plurality of heat transfer tubes provide a plurality of water flow paths arranged in parallel with each other. With this structure, as compared with the structure in which only a single water flow path is provided, the length of each water flow path can be shortened, so that the water pressure drop in the water flow process can be reduced. Therefore, the heat exchanger is usable even under the conditions in which the water pressure in supplying water to each of the heat transfer tubes is low.

However, the above-described conventional structure has the following drawbacks.

Generally, the header is connected to the heat transfer tubes by welding or brazing. In this case, however, it is difficult to detach the header from the heat transfer tubes. Therefore, when the heat transfer tube is clogged, the repair of the heat transfer tube in the state detached from the header is difficult. In this way, the conventional structure is inconvenient for maintenance.

The structure disclosed in Japanese laid-open utility model publication No. 57-200853 includes a header provided with a plurality of relatively short joint tubes. By fitting the joint tubes to the ends of the heat transfer tubes, the header is connected to the heat transfer tubes. With this structure, the joint tubes and the heat transfer tubes can be detachably connected to each other without performing welding or brazing. Therefore, the inconvenience for maintenance is removed.

However, the parts of the heat exchanger may include a dimensional error. Specifically, for example, in manufacturing a heat exchanger, through-holes are formed at a wall of the casing. The heat transfer tubes are inserted into the through-holes and then bonded to the casing by performing welding with respect to the portions around the through-holes. However, this method often causes a relatively large dimensional error in the arrangement of the ends of the plurality of heat transfer tubes. Further, an error in the arrangement is often caused in providing a plurality of joint tubes at a header. When the arrangement of the heat transfer tubes and the joint tubes of the header include such dimensional errors, it is difficult to properly fit the heat transfer tubes to the joint tubes, so that the proper connection may not be performed.

SUMMARY OF THE INVENTION

An object of the present invention is to solve or alleviate the above-described problems.

According to a first aspect of the present invention, there is provided a heat exchanger comprising: a casing into which a heating medium is to be introduced; a plurality of heat transfer tubes arranged in the casing; a plurality of first joint tubes respectively connected to the heat transfer tubes, arranged outside the casing generally in parallel with each other and extending in a predetermined direction; a header provided with a plurality of second joint tubes extending in the predetermined direction and arranged generally in parallel with each other; and a plurality of joints of the first joint tubes and the second joint tubes. The plurality of joints include at least one slide joint and at least one butt joint. At the slide joint, an end of the first joint tube and an end of the second joint tube are fitted to each other slidably in the predetermined direction. At the butt joint, an end of either one of the first and the second joint tubes butts against a sealing surface provided at the other one of the first and the second joint tubes in the predetermined direction. The butt position of the sealing surface and the end is variable in a direction crossing the predetermined direction.

Preferably, the heat exchanger of the present invention includes at least three joints, and one of the three joints is the slide joint, where as the other two joints are the butt joints. The slide joint may be arranged between the two butt joints.

Preferably, the heat exchanger of the present invention includes at least three joints, and one of the three joints is the butt joint, where as the other two joints are the slide joints. The butt joint may be arranged between the two slide joints.

Preferably, the heat exchanger according to the present invention further comprises an elastic ring fitted into an end of either one of the first and the second joint tubes. The ring may include a surface facing the other one of the first and the second joint tubes, and this surface may serve as the sealing surface.

Preferably, the butt joint includes a first flange and a second flange provided at an end of the first joint tube and an end of the second joint tube, respectively, and a press member formed separately from the first and the second joint tubes. The press member may be fastened to the second flange to press the first flange against the sealing surface.

Preferably, the press member is ring-shaped and fitted around one of the first and the second joint tubes which is provided with the first flange.

Preferably, the slide joint includes a sealing O-ring attached to an outer circumference of one of the first and the second joint tubes. The O-ring may be held in slidable contact with an inner circumferential surface of the other one of the first and the second joint tubes.

According to a second aspect of the present invention, there is provided a water heater comprising a burner and a heat exchanger. The heat exchanger comprises: a casing into which combustion gas generated by the burner is to be introduced; a plurality of heat transfer tubes arranged in the casing; a plurality of first joint tubes respectively connected to the heat transfer tubes, arranged outside the casing generally in parallel with each other and extending in a predetermined direction; a header provided with a plurality of second joint tubes extending in the predetermined direction and arranged generally in parallel with each other; and a plurality of joints of the first joint tubes and the second joint tubes. The plurality of joints include at least one slide joint and at least one butt joint. At the slide joint, an end of the first joint tube and an end of the second joint tube are fitted to each other slidably in the predetermined direction. At the butt joint, an end of either one of the first and the second joint tubes butts against a sealing surface provided at the other one of the first and the second joint tubes in the predetermined direction. The butt position of the sealing surface and the end is variable in a direction crossing the predetermined direction.

Other features and advantages of the present invention will become more apparent from detailed description given below with reference to the accompanying drawings.

BEST MODE FOR CARRYING OUT THE INVENTION

Figure 1:
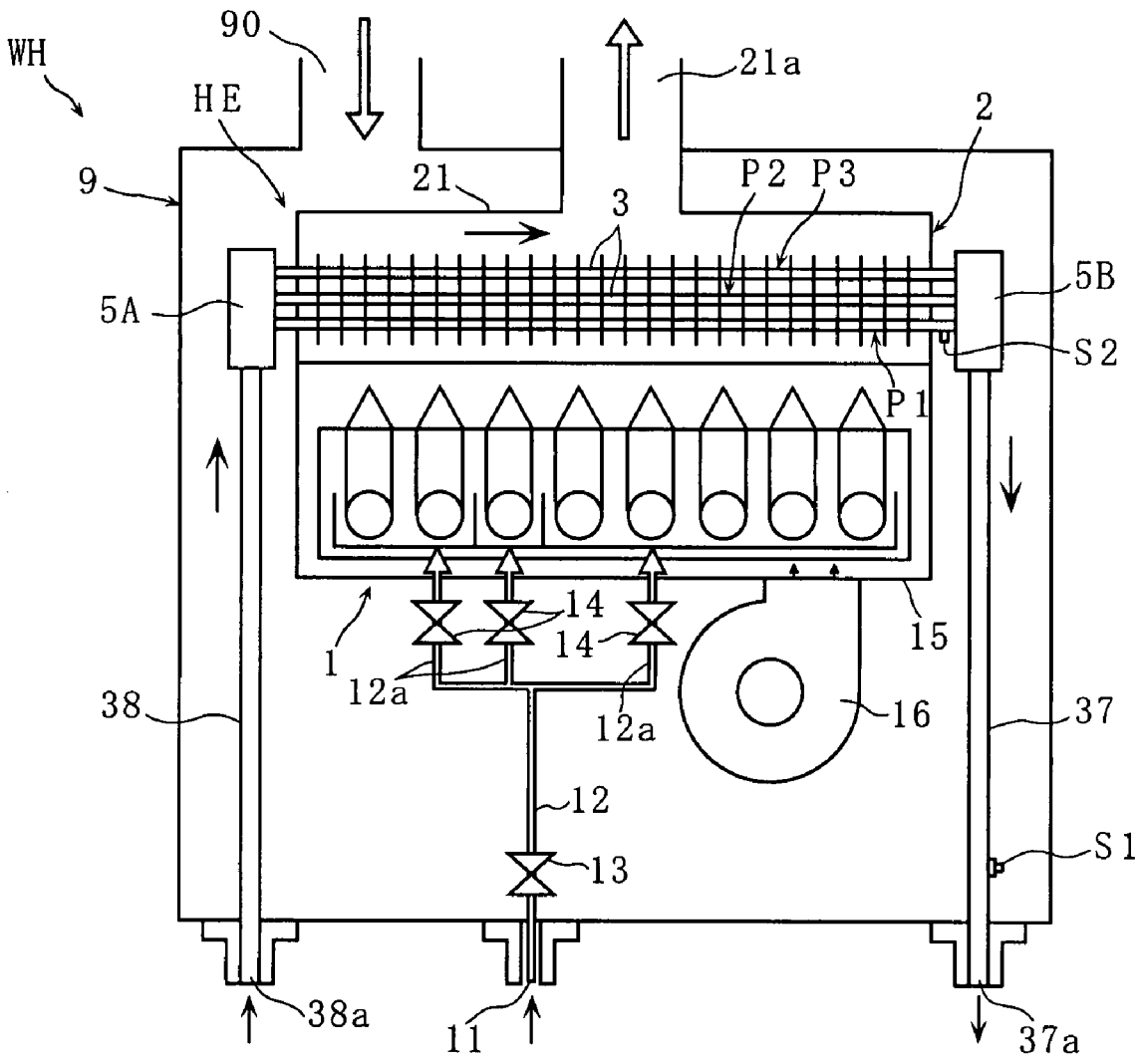
FIG. 1 schematically shows an example of water heater according to the present invention.

Preferred embodiments of the present invention will be described below with reference to the accompanying drawings.

FIGS. 1-5 show an example of water heater according to the present invention. As better shown in FIG. 1, the water heater WH according to this embodiment includes a burner 1, a heat exchanger HE and an external case 9 accommodating these members.

The burner 1 generates combustion gas as heating medium and supplies the combustion gas to the heat exchanger HE. As the burner 1, various known types of burners can be used. In this embodiment, the burner 1 is a gas burner and burns fuel gas supplied from a fuel gas supply port 11 through a pipe 12. The pipe 12 is provided with a gas pressure regulating valve 13 and branches into a plurality of pipe portions 12*a* provided correspondingly to a plurality of combustion are as of the burner 1. Each of the pipe portions 12*a* is provided with a valve 14 for individually controlling fuel gas supply to the relevant combustion are a. The burner 1 is accommodated in a casing 15, and air for combustion is supplied from below into the casing 15 by a fan 16. The external case 9 is provided with an air inlet 90, and air is introduced into the external case 9 through the air inlet 90 to serve as the air for combustion.

Figure 2:
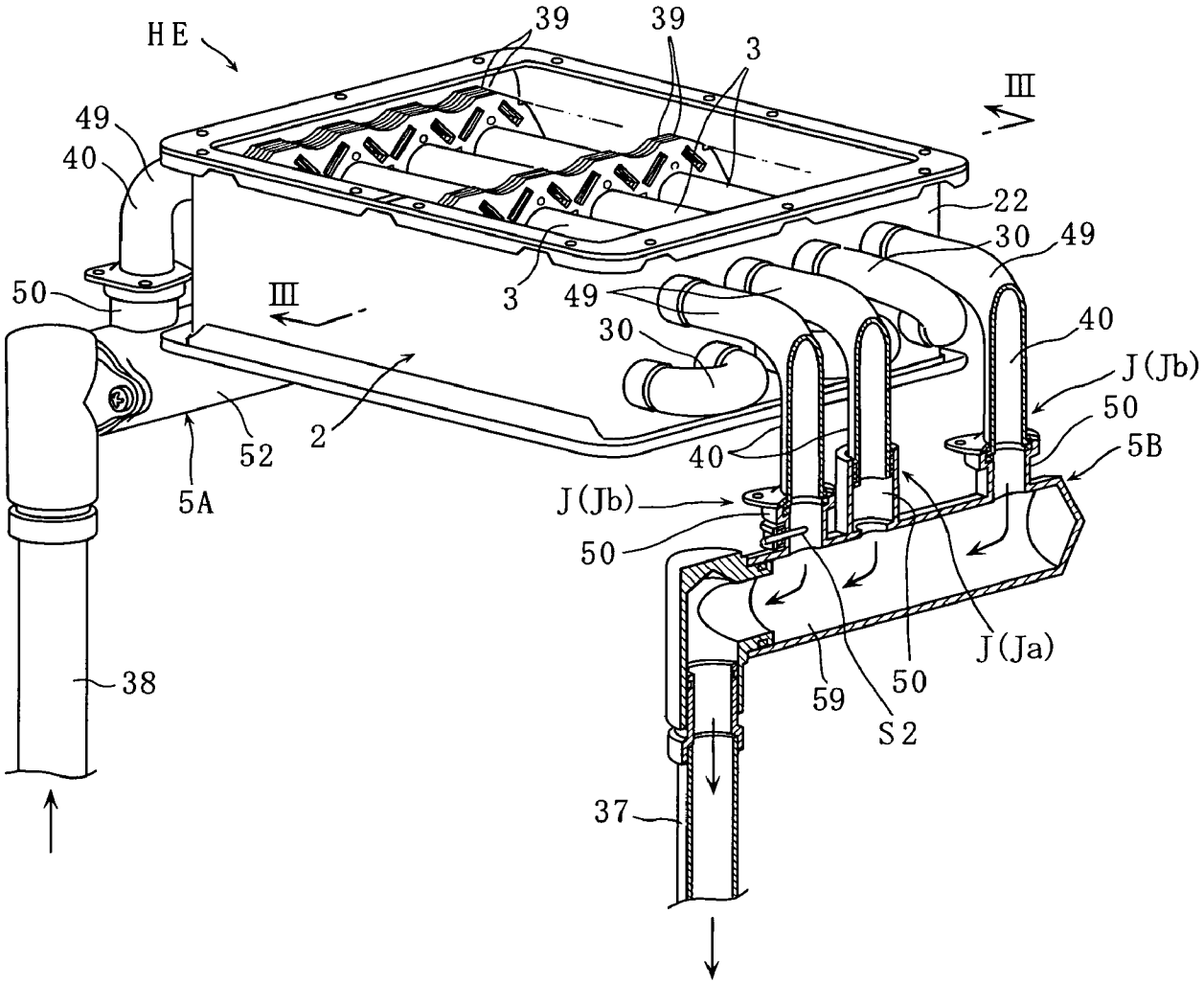
FIG. 2 is a partially sectional perspective view schematically showing the heat exchanger used for the water heater of FIG. 1.

As better shown in FIG. 2, the heat exchanger HE includes a casing 2, a plurality of heat transfer tubes 3, a header 5A for water inflow, a header 5B for hot-water outflow, a plurality of first joint tubes 40, a plurality of second joint tubes 50 and a plurality of joints J.

The casing 2 comprises a generally rectangular metal frame whose top and bottom are open and is provided above the burner 1. Combustion gas is supplied into the casing 2 through the bottom opening. At the top of the casing 2A, a cover 21 is provided. The cover 21 is formed with a gas discharge port 21*a* for discharging the combustion gas passed upward through the casing 2 to the outside of the external case 9 (See FIG. 1).

Each of the heat transfer tubes 3 is a metal tube provided with a plurality of fins 39. The opposite ends of each heat transfer tube 3 penetrate through side walls 22 of the casing 2 and are supported by the sidewalls 22. With this arrangement, the heat transfer tubes 3 extend generally horizontally in the casing 2. As shown in FIG. 2, on the header 5B side, three elbows 49, for example, are connected to the ends of selected ones of the heat transfer tubes 3. Of these elbows 49, the portions extending in the vertical direction and arranged generally in parallel with each other in a horizontal direction are the first joint tubes 40. Though not clearly shown in FIG. 2, also on the header 5A side, elbows 49 are connected to the ends of selected ones of the heat transfer tubes 3 to provide first joint tubes 40.

Figure 3:
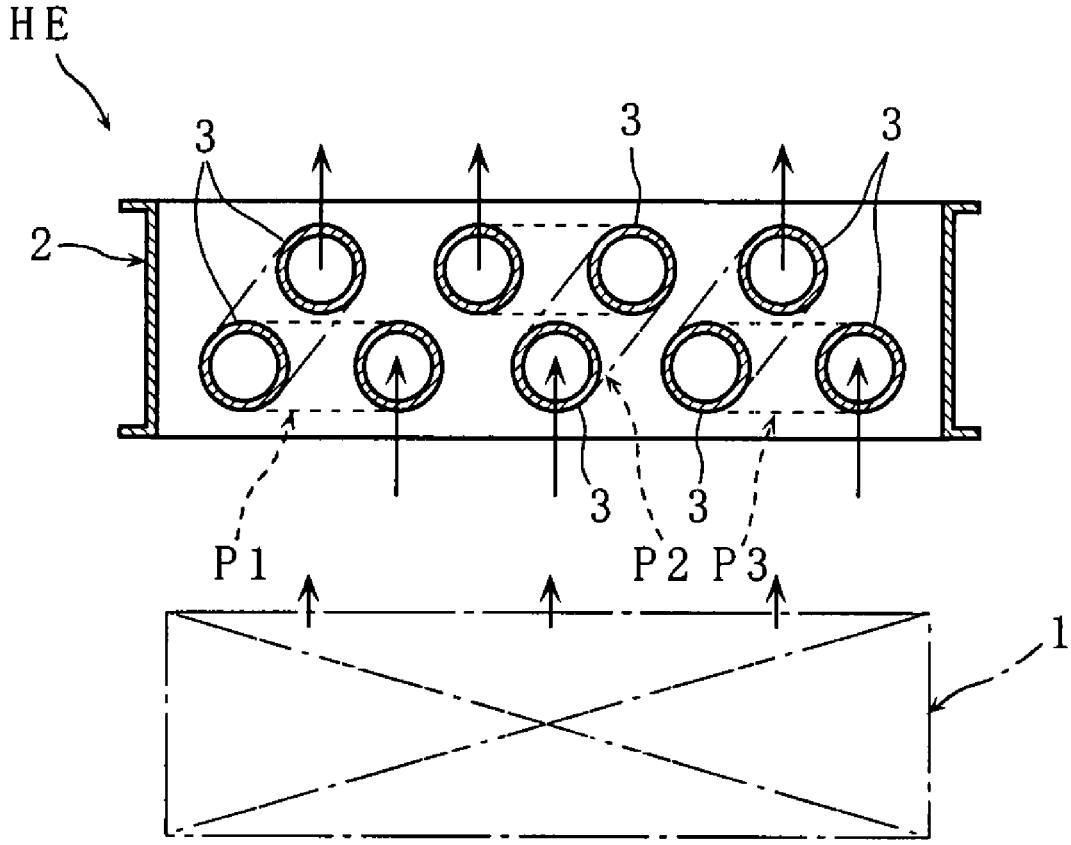
FIG. 3 is a schematic sectional view taken along lines III-III in FIG. 2.

To the ends of the heat transfer tubes 3 to which the elbows 49 are not connected, U-shaped tubes 30 are connected. Specifically, in this embodiment, nine heat transfer tubes 3 are arranged in two rows in a staggered manner, as shown in FIG. 3. Each of the U-shaped tubes 30 is so connected as to provide communication between three of the nine heat transfer tubes 3. As a result, the nine heat transfer tubes 3 form three water flow paths P1-P3. The water flow paths P1-P3 communicate with the interior of the first joint tubes 40.

As shown in FIG. 2, each of the headers 5A and 5B includes a tubular body 59 one end of which is closed. The second joint tubes 50 are provided at the circumferential wall of the tubular body 59. The second joint tubes 50 extend in the vertical direction and are arranged generally in parallel with each other in a horizontal direction. As shown in FIG. 1, a water supply pipe 38 including a water inlet 38*a* at one end thereof is connected to the header 5A, where as a hot-water discharge pipe 37 including a hot-water outlet 37*a* at one end thereof is connected to the header 5B. A temperature sensor S1 for detecting the temperature of the hot water is attached to the hot-water discharge pipe 37.

Figure 4:
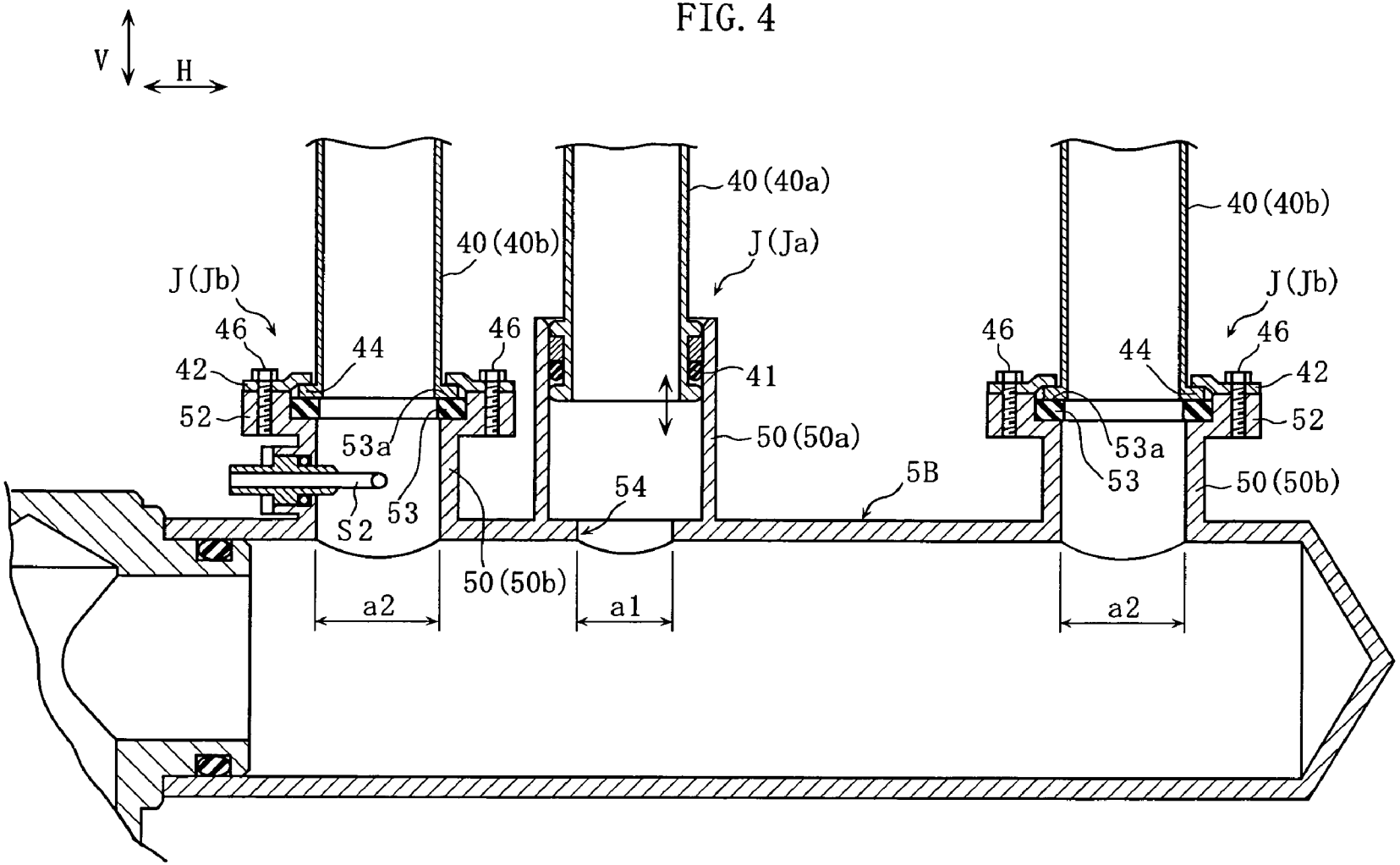
FIG. 4 is a sectional view showing a principal portion of the heat exchanger shown in FIG. 2.
Figure 5:
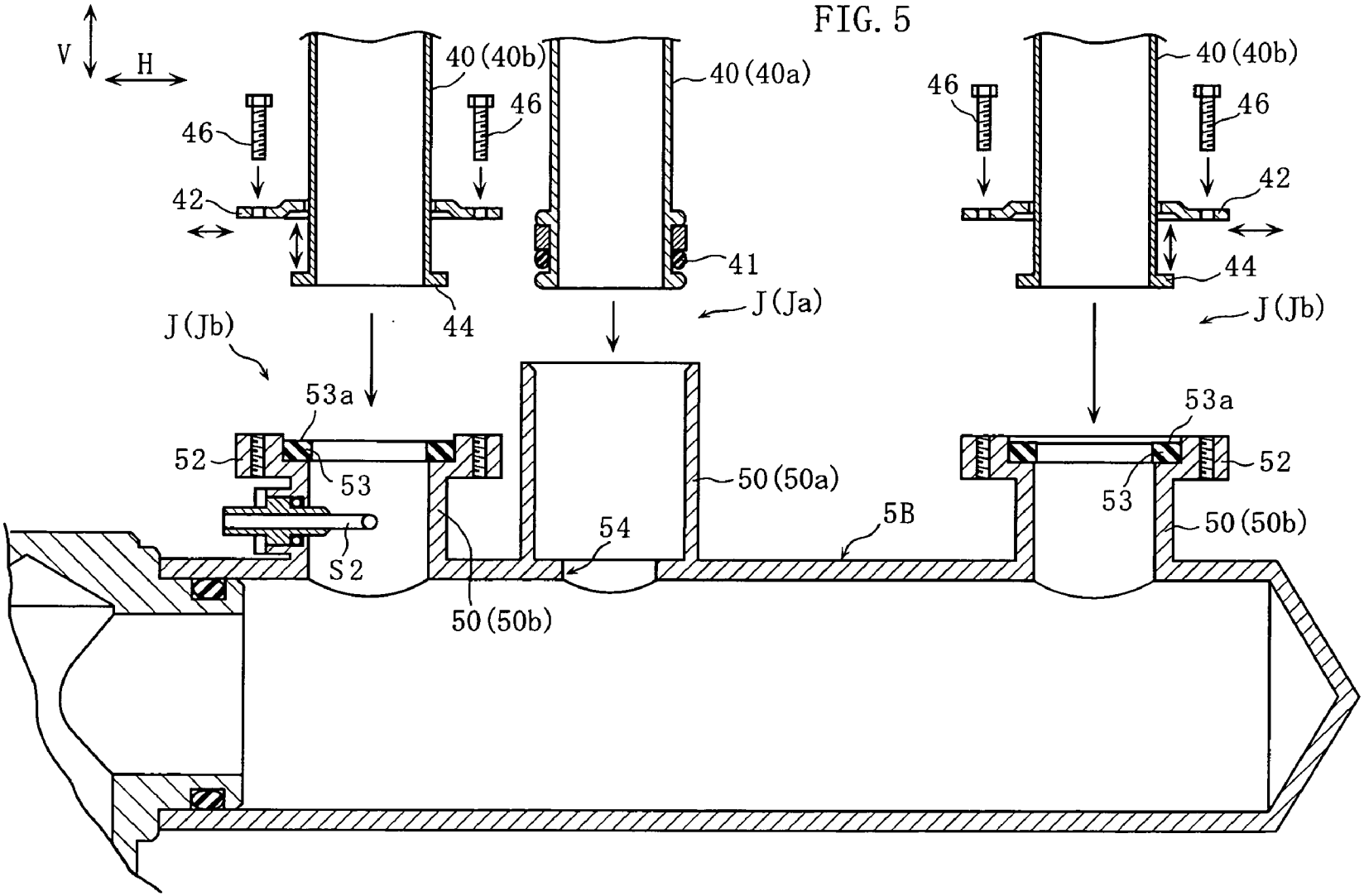
FIG. 5 is an exploded sectional view of the portion shown in FIG. 4.

As better shown in FIGS. 4 and 5, the first joint tubes 40 and the second joint tubes 50 are connected to each other at the joints J. (In FIGS. 4 and 5, the arrow V indicates the vertical direction, where as the arrow H indicates the horizontal direction.) The joints F include one slide joint J (Ja) and two butt joints J (Jb).

The slide joint Ja is positioned between the two butt joints Jb. At the slide joint Ja, the first joint tube 40 (40*a*) is fitted into the second joint tube 50 (50*b*) slidably in the vertical direction V. A sealing O-ring 41 made of an elastic material such as synthetic rubber is fitted around the outer circumference of the end of the first joint tube 40*a*. The O-ring 41 is held in slidable contact with the inner circumferential surface of the second joint tube 50*a*.

Each of the butt joints Jb includes a first flange 44 and a second flange 52 provided at the end of the first joint tube 40 (40*b*) and the end of the second joint tube 50 (50*b*), respectively, a press member 42, and a ring 53 providing a sealing surface 53*a*. The first and the second flanges 44 and 52 are formed integrally on the ends of the first and the second joint tubes 40*b* and 50*b*. The first flange 44 is a portion to be held in contact with the sealing surface 53*a*, where as the second flange 52 is a portion to hold the ring 53 and to be fastened to the press member 42. Therefore, the second flange 52 is made larger in diameter and thickness than the first flange 44.

The press member 42 is a metal member which is formed separately from the first and the second joint tubes 40*b* and 50*b* and ring-shaped with a through-hole at the center thereof. The press member 42 is fastened to the second flange 52 using a plurality of bolts 46 so as to press the first flange 44 against the sealing surface 53*a*. The press member 42 is loosely fitted around the first joint tube 40*b*. Therefore, before the press member 42 is fastened to the second flange 52, the press member 42 is slidable relative to the first joint tube 40 in the vertical direction V and movable horizontally in any direction within a predetermined dimension range.

The ring 53 is fitted in the end opening of the second joint tube 50*b*. The upper surface of the ring 53 is the sealing surface 53*a*. As noted before, the first flange 44 butts against the sealing surface 53*a*. The first flange 44 basically serves to connect the first and the second joint tubes 40*b* and 50*b* to each other by being sandwiched between the press member 42 and the second flange 52. Further, the provision of the first flange 44 increases the butting contact are a with the sealing surface 53*a*. Thus, the first flange 44 also serves to enhance the sealing performance at this portion. Preferably, similarly to the above-described O-ring 41, the ring 53 may be made of an elastic material such as synthetic rubber to further enhance the sealing performance.

In FIGS. 4 and 5, only the structure of the header 5B and the nearby portion is shown, and the structure related to the header 5A is not shown. However, except the structure of the part which will be described later, the structure related to the header 5A is the same as the structure described above with reference to FIGS. 4 and 5.

The header 5B is formed with an orifice 54 communicating with the interior of the second joint tube 50*a*. With this arrangement, the opening area a 1 at the base end of the second joint tube 50*a* is smaller than the opening area a2 at the base end of the second joint tube 50*b*. The interior of the second joint tube 50*a* communicates with the water flow path P2 shown in FIG. 3. The water flow path P2 is made up of three heat transfer tubes 3, one of which is arranged on the lower row which is closer to the burner 1 while the remaining two of which are arranged on the upper row. Therefore, as compared with the other two water flow paths P1 and P3 each made up of two heat transfer tubes 3 arranged on the lower row and one heat transfer tube 3 arranged on the upper row, the water flow path P2 is heated to a lesser degree by combustion gas. However, by the provision of the orifice 54, the water flow in the flow path P2 is reduced, where as the water flow in the flow paths P1, P3 is increased. As a result, the heat exchange efficiency is enhanced. For example, the orifice 54 may be provided by attaching an appropriate ring member to the inside of the header 5B. Further, the orifice 54 may be provided at the header 5A instead of or in addition to the header 5B. Even in such a case, the same advantage as described above is obtained.

At least one of the second joint tubes 50 is provided with a temperature sensor S2 for detecting the temperature of the hot water flowing through the tube. In this embodiment, the temperature sensor S2 is so provided as to detect the temperature of the hot water which has flowed through the water flow path P1. The temperature sensor S2 is provided at the header 5B for hot-water outflow and not provided at the header 5A for water inflow.

The operation and advantages of the water heater WH will be described below.

The work for connecting the headers 5A and 5B to the heat transfer tubes 3 of the heat exchanger HE is performed as follows. As shown in FIGS. 4 and 5, at the slide joint Ja, the end of the first joint tube 40*a* is fitted into the end opening of the second joint tube 50*a*. By this process, the O-ring 41 comes into contact with the inner circumferential surface of the second joint tube 50*a*, whereby excellent sealing performance is achieved.

At the butt joint Jb, the flange 44 of the first joint tube 40*b* is brought into contact with the sealing surface 53*a* of the ring 53. Then, the press member 42 is put close to the second flange 52 and fastened to the flange 52 with bolts 46. The first flange 44 is sandwiched between the press member 42 and the second flange 52, so that the first joint tube 40*b* is connected to the second joint tube 50*b* so as not to separate from the second joint tube 50*b*. Since the end surface of the flange 44 and the sealing surface 53*a* are properly held in contact with each other, excellent sealing performance at this portion is achieved.

The arrangement pitch and length of the first joint tubes 40 may have dimensional errors. This holds true for the second joint tubes 50. The heat exchanger HE of the invention properly copes with such a situation as follows.

Since the first and the second joint tubes 40*a* and 50*a* are fitted to each other at the slide joint Ja, all of the first and the second joint tubes 40 and 50 are prevented from moving relative to each other in the horizontal direction H. At the butt joint Jb, due to e.g. an error in the arrangement pitch of the first joint tubes 40, the center of the first flange 44 and that of the sealing surface 53*a* may slightly deviate from each other in the horizontal direction H. Even in such a case, the first flange 44 and the sealing surface 53*a* properly butt against each other. Therefore, such an error in the arrangement pitch is properly compensated. Moreover, since the first flange 44 and the sealing surface 53*a* butt against each other at the butt joint Jb, the movement of all of the first and the second joint tubes 40 and 50 in the vertical direction V is restricted, so that it is difficult to move the first joint tube 40 further downward relative to the second joint tube 50. At the slide joint Jb, however, the first and the second joint tubes 40*a* and 50*a* are properly fitted to each other for connection, irrespective of such restriction of movement in the vertical direction V. In this way, all of the first and the second joint tubes 40 and 50 are properly connected to each other.

Unlike this embodiment, when all the joints J are structured as slide joints, dimensional errors in the horizontal direction H cannot be compensated. When all the joints J are structured as butt joints, dimensional errors in the vertical direction V cannot be compensated. According to this embodiment, both of the errors in the horizontal direction H and the errors in the vertical direction V are properly compensated, so that the headers 5A and 5B are properly connected to the heat transfer tubes 3.

Particularly, the structure of this embodiment in which the single slide joint Ja is arranged between two butt joints Jb has the following advantages.

Figure 6:
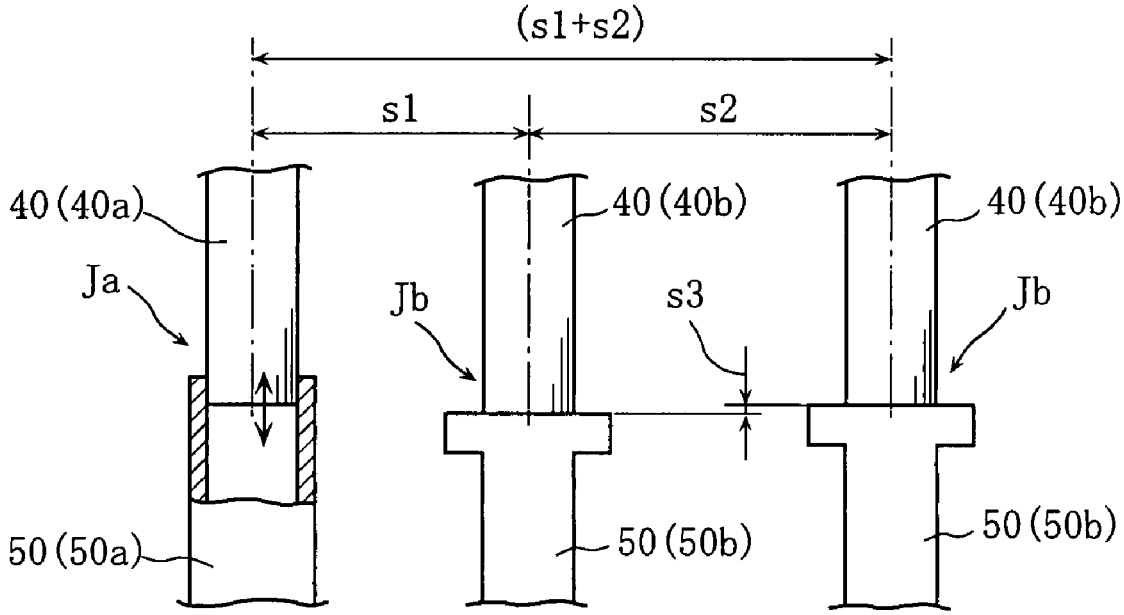
FIG. 6 schematically shows a comparative example relative to the embodiment shown in FIGS. 1-5.

FIG. 6 shows a comparative example relative to this embodiment. However, this comparative example is also included in the technical scope of the present invention. In this comparative example, two butt joints Jb are arranged on the right side of a slide joint Ja. With this arrangement, when dimensional errors s1 and s2 are present in the arrangement of the first joint tubes 40, the dimensional error between the slide joint Ja and the butt joint Jb on the right end is the total of the dimension errors, i.e., (s1+s2). Therefore, at the butt joint Jb on the right end, the dimensional error (s1+s2) needs to be compensated. According to this embodiment, however, such accumulation of errors is prevented. Further, in the comparative example shown in FIG. 6, the two butt joints Jb are arranged adjacent to each other. With this arrangement, when a dimensional errors 3 in the vertical direction V is present between the butting portions, the influence of the error s3 is large. Therefore, to properly position the upper ends of the two second joint tubes 50*b* relative to the lower ends of the first joint tubes 50*a*, the header 5B needs to be inclined. According to this embodiment, however, the distance between two butt joints Jb is larger than that in the comparative example. Therefore, the influence of such an error in the vertical direction V is small. Therefore, it is possible to properly butt the flange 44 and the sealing surface 53*a* against each other while making the angle of inclination of the header 5B smaller than that in the comparative example.

In the water heater WH of this embodiment, as shown in FIG. 1, the water supplied into the water inflow header 5A through the water inlet 38*a* flows through the plurality of water flow paths P1-P3 of the heat transfer tubes 3 and is heated by combustion gas in the flowing process. The heated water flows from the waterflow paths P1-P3 into the hot-water outflow header 5B to merge at the header 5B. The heated water is then supplied to the outside through the hot-water outlet 37*a*. In this water flow process, the water flow paths P1-P3 may be clogged up with impurities. With the structure of the water heater WH, the water inflow header 5A and the hot-water outflow header 5B of the heat exchanger HE can be detached easily by loosening the bolts 46. Therefore, the repair to remove the clog can be performed properly. Further, the flow test can be performed easily in the state in which the headers 5A, 5B are mounted and also in the state in which the headers 5A, 5B are detached.

Moreover, in the water heater WH, it is possible to detect the clogging of the water flow paths P1-P3 and roughly determine the position of the clogging. For example, when the water flow path P1 is clogged, the amount of water flow in the water flow path P1 reduces, so that the temperature of the water in the water flow path P1 rises extraordinarily. During the hot-water supply operation, the temperature detected by the temperature sensor S1 and that detected by the temperature sensor S2 are compared with each other. When the temperature at the temperature sensor S2 becomes higher than the temperature at the temperature sensor S1 by more than a predetermined amount, it is determined that the water flow path P1 is clogged. When the water flow path P1 or P2 is clogged, the temperature of the water at the clogged portion rises extraordinarily. However, the outflow hot-water temperature is so controlled as to keep a predetermined value. Therefore, the temperature of the water in the water flow path P1 drops. Therefore, when the temperature at the temperature sensor S2 becomes lower than the temperature at the temperature sensor S1 by more than a predetermined amount, it is determined that the water flow path P2 or P3 is clogged. Such determination may be performed by a controller (not shown) which controls the operation of each part of the water heater WH. In this way, since the clogging in the heat exchanger HE can be detected properly, the countermeasure against the clogging can be taken quickly, which is advantageous. Further, the position of the clogging can be roughly determined, which is advantageous for performing the repair. The same advantages are obtained when the temperature of the hot water flowing from the water flow path P2 or P3 is detected instead of detecting the temperature of the hot water from the water flow path P1.

The present invention is not limited to the foregoing embodiment. The specific structure of each part of the heat exchanger and the water heater according to the present invention can be modified in design in many ways.

Figure 7:
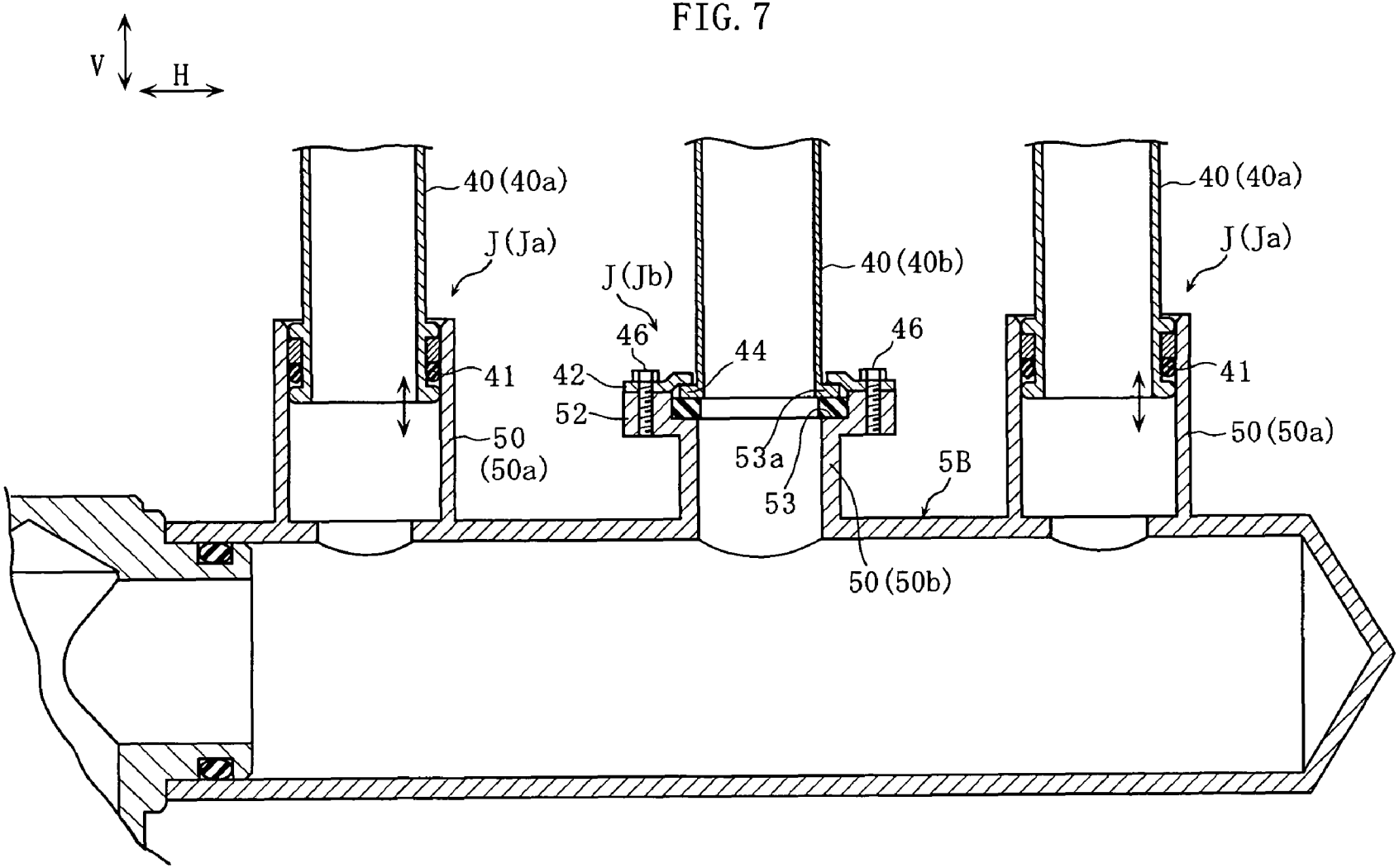
FIG. 7 is a sectional view showing another example of the principal portion of a heat exchanger according to the present invention.

FIG. 7 shows another embodiment of the present invention. In this figure, the elements which are identical or similar to those of the foregoing embodiment are designated by the same reference signs as those used for the foregoing embodiment.

In the embodiment shown in FIG. 7, three joints J are provided, one of which is a butt joint Jb and the remaining two of which are slide joints Ja. The butt joint Jb is positioned between the two slide joints Ja. With this arrangement again, as compared with a structure in which all the three joints J are butt joints or slide joints, the influence of an error in the arrangement of the first and the second joint tubes 40 and 50 is reduced, so that the first and the second joint tubes 40 and 50 can be easily connected to each other. In this way, in the present invention, it is only necessary that the plurality of joints include at least one slide joint and at least one butt joint. The number and arrangement of the slide joints and butt joints may be selected appropriately. Further, it is only necessary that a plurality of joints of the first and the second joint tubes are provided, and the number of joints is not limited to three.

The first joint tube in the present invention may be formed integrally with the heat transfer tube. That is, part of the heat transfer tube may project from the casing, and the projecting part may constitute the first joint tube utilized for connection to the header. The second joint tube in the present invention may be provided integrally with or separately from the header. The length of each of the first and the second joint tubes is not limited to a specific value, though it does not need to be long. The direction in which the first and the second joint tubes are connected to each other (the slide direction of the slide joint) is not limited to the vertical direction.

Unlike the foregoing embodiment, at the slide joint, the second joint tube may be fitted into the first joint tube. At the butt joint, unlike the foregoing embodiment, the ring-shaped sealing surface may be provided at the first joint tube so that the end of the second joint tube butts against the sealing surface. The ring-shaped sealing surface may be formed directly on the first or the second joint tube by working the inner circumferential surface of the joint tube, for example. Further, as the means for fastening the press member to the second flange, a screw or a clamp may be used instead of a bolt.

It is preferable that both of the water inflow header and the hot-water outflow header have the tube connection structure intended by the present invention. However, only either one of the water inflow header and the hot-water outflow header may have the tube connection structure intended by the present invention. The water heater in the present invention means an apparatus having the function to generate hot water (including heated antifreeze) and also includes an apparatus for generating hot water for the purposes other than hot water supply.

The invention claimed is:

1. A heat exchanger comprising:

a casing into which a heating medium is to be introduced;

a plurality of heat transfer tubes arranged in the casing;

a plurality of first joint tubes respectively connected to the heat transfer tubes, arranged outside the casing generally in parallel with each other and extending in a predetermined direction;

a header provided with a plurality of second joint tubes extending in the predetermined direction and arranged generally in parallel with each other; and a plurality of joints of the first joint tubes and the second joint tubes;

wherein the plurality of joints include at least one slide joint and at least one butt joint;

wherein, at the slide joint, an end of the first joint tube and an end of the second joint tube are fitted to each other slidably in the predetermined direction; and wherein, at the butt joint, an end of either one of the first and the second joint tubes butts against a sealing surface provided at the other one of the first and the second joint tubes in the predetermined direction, the butt position of the sealing surface and the end being variable in a direction crossing the predetermined direction.

2. The heat exchanger according to claim 1, wherein at least three joints are provided; and wherein one of the three joints is the slide joint, where as the other two joints are the butt joints, the slide joint being arranged between the two butt joints.

3. The heat exchanger according to claim 1, wherein at least three joints are provided; and wherein one of the three joints is the butt joint, where as the other two joints are the slide joints, the butt joint being arranged between the two slide joints.

4. The heat exchanger according to claim 1, further comprising an elastic ring fitted into an end of either one of the first and the second joint tubes, wherein the ring includes a surface facing the other one of the first and the second joint tubes, the surface serving as the sealing surface.

5. The heat exchanger according to claim 1, wherein the butt joint includes a first flange and a second flange provided at an end of the first joint tube and an end of the second joint tube, respectively, and a press member formed separately from the first and the second joint tubes; and wherein the press member is fastened to the second flange to press the first flange against the sealing surface.

6. The heat exchanger according to claim 5, wherein the press member is ring-shaped and fitted around one of the first and the second joint tubes which is provided with the first flange.

7. The heat exchanger according to claim 1, wherein the slide joint includes a sealing O-ring attached to an outer circumference of one of the first and the second joint tubes, the O-ring being held in slidable contact with an inner circumferential surface of the other one of the first and the second joint tubes.

8. A water heater comprising a burner and a heat exchanger, the heat exchanger comprising:

a casing into which combustion gas generated by the burner is to be introduced;

a plurality of heat transfer tubes arranged in the casing;

a plurality of first joint tubes respectively connected to the heat transfer tubes, arranged outside the casing generally in parallel with each other and extending in a predetermined direction;

a header provided with a plurality of second joint tubes extending in the predetermined direction and arranged generally in parallel with each other; and a plurality of joints of the first joint tubes and the second joint tubes;

wherein the plurality of joints include at least one slide joint and at least one butt joint;

wherein, at the slide joint, an end of the first joint tube and an end of the second joint tube are fitted to each other slidably in the predetermined direction; and wherein, at the butt joint, an end of either one of the first and the second joint tubes butts against a sealing surface provided at the other one of the first and the second joint tubes in the predetermined direction, the butt position of the sealing surface and the end being variable in a direction crossing the predetermined direction.

* * * * *